United States Patent [19]

French

[11] 4,266,612

[45] May 12, 1981

[54] IN SITU RECOVERY OF SHALE OIL

[75] Inventor: Gordon B. French, Rifle, Colo.

[73] Assignee: Occidental Oil Shale, Inc., Grand Junction, Colo.

[21] Appl. No.: 780,083

[22] Filed: Mar. 22, 1977

Related U.S. Application Data

[60] Division of Ser. No. 603,704, Aug. 11, 1975, Pat. No. 4,043,595, and a continuation-in-part of Ser. No. 505,276, Sep. 12, 1974, abandoned, Ser. No. 505,363, Sep. 12, 1974, abandoned, and Ser. No. 505,457, Sep. 12, 1974, abandoned.

[51] Int. Cl.[3] ..... E21B 43/247; E21C 41/10

[52] U.S. Cl. ..... 166/299; 166/259; 299/2; 299/13

[58] Field of Search ..... 166/247, 256, 259, 299; 299/2, 13

[56] References Cited

U.S. PATENT DOCUMENTS 4,181,361 1/1980 Ridley et al. ..... 299/2

*Primary Examiner*—Stephen J. Novosad
*Assistant Examiner*—George A. Suchfield
*Attorney, Agent, or Firm*—Christie, Parker & Hale

[57] ABSTRACT

An in situ oil shale retort is formed in a subterranean oil shale deposit by excavating a columnar void having a vertically extending free face, drilling blasting holes adjacent to the columnar void, loading the blasting holes with explosive, and detonating the explosive in a single round to expand the shale adjacent to the columnar void toward the free face to fill with fragmented oil shale the columnar void and the space in the in situ retort originally occupied by the expanded shale prior to the expansion. A room having a horizontal floor plan that coincides approximately with the horizontal cross section of the retort to be formed is excavated so as to intersect the columnar void. The room can lie above the columnar void, below the columnar void, or intermediate the ends of the columnar void. The expanded or fragmented shale has a low average void volume. The void volume of the fragmented shale increases at the bottom of the in situ retort. In one embodiment the higher void volume is obtained since the ratio of the cross-sectional area of the columnar void to the horizontal cross-sectional area of the retort is decreased near the bottom. Backfilling part of a void with fragmented shale prior to explosive expansion provides a high void volume in another embodiment. In an embodiment with a room at the bottom of the columnar void, shale in one region can expand downwardly toward the room as well as toward the columnar void and hence has a higher void volume than a region where shale expands only toward the columnar void.

4 Claims, 6 Drawing Figures

IN SITU RECOVERY OF SHALE OIL

CROSS REFERENCE TO RELATED APPLICATIONS

This application is a division of application Ser. No. 603,704, filed Aug. 11, 1975, now U.S. Pat. No. 4,043,595, and a continuation-in-part of applications Ser. No. 505,276, Ser. No. 505,363, and Ser. No. 505,457, filed Sept. 12, 1974, all abandoned, the disclosures of which are incorporated herein by reference.

BACKGROUND OF THE INVENTION

This invention relates to the recovery of liquid and gaseous products from oil shale. The term "oil shale" as used in the industry is in fact a misnomer; it is neither shale nor does it contain oil. It is a formation comprising marlstone deposit interspersed with layers of an organic polymer called "kerogen" which upon heating decomposes to produce carbonaceous liquid and gaseous products. It is the deposit containing kerogen that is called "oil shale" herein, and the liquid product is called "shale oil".

One technique for recovering shale oil is to set up a retort in a subterranean oil shale deposit. The shale within the retort is fragmented and the shale at the top of the retort is ignited to establish a combustion zone. An oxygen containing gas is supplied to the top of the retort to sustain the combustion zone, which proceeds slowly down through the fragmented shale in the retort. As burning proceeds, the heat of combustion is transferred to the shale below the combustion zone to release shale oil and gases therefrom in a retorting zone. Thus, a retorting zone moves from top to bottom of the retort in advance of the combustion zone, and the resulting shale oil and gases pass to the bottom of the retort for collection.

In preparation for the described retorting process, it is important that the shale be fragmented, rather than simply fractured, in order to create high permeability; otherwise, too much pressure is required to pass the gas through the retort. Known methods of creating such high shale permeability call for mining large volumes of the oil shale prior to fragmentation. This is objectionable in two respects. First, mining the shale and transporting it to the ground level are expensive operations. Second, the mined shale is excluded from the in situ retorting process, thus reducing the overall recovery of shale oil from the retort.

SUMMARY OF THE INVENTION

An in situ retort in a subterranean formation containing oil shale contains a permeable fragmented mass of formation containing oil shale. Constituents released from the oil shale during retorting are collected at the bottom of the fragmented mass. The fragmented mass has a low void volume with a bottom portion having a high void volume. The high permeability of the bottom portion serves to deliver released constituents from the oil shale to an outlet for collection and to promote uniform gas flow through the in situ retort.

BRIEF DESCRIPTION OF THE DRAWINGS

The features of specific embodiments of the best mode contemplated of carrying out the invention are illustrated in the drawings, in which:

—FIGS. 1 and 3 are bottom sectional views through a plane indicated in FIG. 2, and FIG. 2 is a side sectional view through a plane indicated in FIG. 1;

DETAILED DESCRIPTION OF THE SPECIFIC EMBODIMENTS

I. General Discussion of Invention

Figure 1:
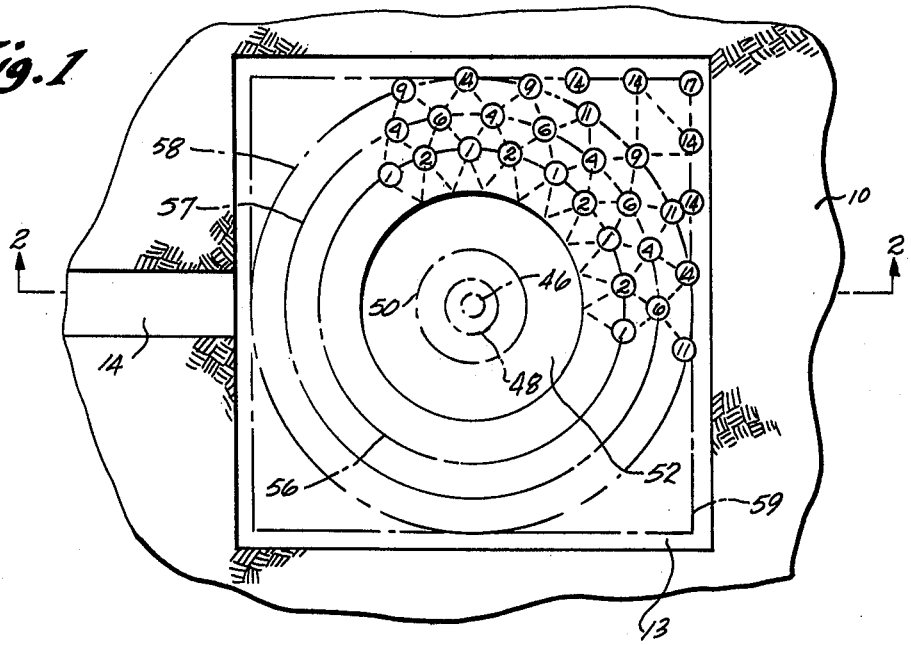
FIGS. 1 through 3 depict a portion of a subterranean formation containing an oil shale deposit during enlargement of an initial cylindrical columnar void to a final columnar void in lateral increments and the preparation of the shale adjacent to the final columnar void for multi-directional inward expansion

A retort in a subterranean formation containing oil shale, having top, bottom and side boundaries of unfragmented formation, is formed by excavating a first portion of the oil shale from within such boundaries to form at least one columnar void, the surface of the formation which defines the columnar void presents at least one free face that extends vertically through the subterranean oil shale deposite, and leaves a second portion of the formation, which is to be fragmented by expansion toward the columnar void, within the boundaries of the retort and extending away from a free face. The second portion is explosively expanded toward the columnar void in one or more segments. The expansion of the oils shale toward the columnar void fragments the oil shale thereby distributing the void volume of the columnar void throughout the retort.

The location of the base of operation or work area from which the blasting holes for explosive expansion are drilled and loaded with explosive can be located within or external to the boundaries of the retort to be formed. The base of operation can be one or more tunnels lying either outside or within the retort to be formed. Usually, however, the base of operation is a room lying within the space in which the retort is to be formed. The room has a floor plan that coincides approximately with the horizontal cross section of the retort to be formed and lies in a plane extending approximately perpendicular to the free face of the columnar void to provide unlimited access to the region adjacent to the columnar void for drilling and explosive loading equipment. This room can be at the upper boundary of the retort, the lower boundary of the retort, or at intermediate levels between the upper and lower boundaries of the retort. There can also be more than one base of operation along the height of the columnar void from which blasting holes are drilled and loaded.

The distributed void fraction of the retort, i.e., the ratio of the void volume to the total volume in the retort, is controlled by selecting the horizontal cross-sectional area of the columnar void or voids. The horizontal cross-sectional area of the columnar void or voids is sufficiently small compared to the horizontal cross-sectional area of the retort that the expanded shale is capable of filling the columnar void or voids and the space occupied by the expanded shale prior to detonation of the explosive. In other words, the horizontal cross-sectional area of the columnar void or voids is not so large that the expanded shale occupies less than the entire space of the columnar void or voids and the space occupied by the expanded shale prior to detonation of the explosive. Thus, remote from the work rooms, the shale in a horizontal slice of the retort along the height of a columnar void, i.e., a segment between two horizontal planes, moves essentially toward the columnar void without moving appreciably upwardly or settling downwardly. This promotes a more uniform permeability and distribution of void volume along the height of retort, because remote from the work rooms there is no appreciable vertical displacement of the fragmented shale. In filling a columnar void and the space occupied by the expanded shale prior to detonation, the particles of the expanded shale become jammed and wedged together tightly so they do not shift or move after fragmentation has been completed. In numerical terms, the horizontal cross-sectional area of the columnar void should be less than about 40% of the horizontal cross-sectional area of the retort in order to fill the columnar void and the space occupied by the expanded shale prior to detonation. In one embodiment of this invention, the horizontal cross-sectional area of the columnar void is preferably not greater than about 20% of the cross-sectional area of the retort, as this is found to provide a void volume in the fragmented oil shale adequate for satisfactory retorting operation.

The horizontal cross-sectional area of the columnar void is also sufficiently large compared to the horizontal cross-sectional area of the retort so that substantially all of the expanded shale within the retort is capable of moving enough during explosive expansion to fragment and for the fragments to reorient themselves. If the horizontal cross-sectional area of the columnar void is too small, a significant quantity of the shale within the retort volume can fracture without fragmenting. If the shale fractures without fragmenting, as when the space for explosive expansion of the shale is insufficient, fissures can be formed and the shale frozen in place without fragmentation. The void volume in fractured (but not fragmented) shale is neither large enough nor suitably distributed for efficient in situ retorting, and the permeability is too small to provide the prescribed gas flow rate through the retort at a reasonable pressure.

In numerical terms, the minimum average horizontal cross-sectional area of the columnar void in view of the above considerations should be above about 10% of the horizontal cross-sectional area of the retort. Below this average percentage value, an undesirable amount of power is required to drive the gas blowers and compressors supplying the retorting gas to the retort.

Within the range of 10% to 20%, the especially preferred horizontal cross-sectional area for the columnar void is about 15% of the horizontal cross-sectional area of the retort. The data collected to date from work in the Piceance Basin of Colorado indicate this value provides a good balance among the various characteristics of the retort, i.e., void volume, permeability, and particle size, without having to excavate excessive amounts of shale to form the columnar void. For example, a retort having a height of about 100 feet can require a pressure drop of less than about 1 psi from top to bottom for vertical movement of a mixture of air and off gas down through the retort at about 1 to 2 standard cubic feet per minute (scfm) per square foot of horizontal cross section of the retort, while retorts having greater heights would require proportionally larger pressure drops. Thus, an adequate gas flow rate through retorts up to 1000 feet in height can be provided with a pressure drop of less than 10 psi from top to bottom. In some areas of the Piceance Basin, a gas pressure of greater than 10 psi is objectionable because it results in excessive gas leakage into the intact shale around the retort.

The recovery of shale oil and product gas from the oil shale in the retort generally involves the movement of a retorting zone through the retort. The retorting zone can be established on the advancing side of a combustion zone in the retort or it can be established by passing heated gas through the retort. It is generally preferred to advance the retorting zone from the top to the bottom of a vertically oriented retort, i.e., a retort having vertical side boundaries such that the shale oil and product gases produced in the retorting zone will move by the force of gravity and with the aid of gases (air or heated gases) introduced at the upper boundary and moving to the lower boundary of the retort for collection.

The combustion zone is maintained and advanced through the retort toward the lower boundary by introducing an oxygen-containing inlet gas through access conduits to the upper boundary of the retort and withdrawing flue gases from below the retorting zone. The inlet gas is generally a mixture of air and a diluent such as retort off gas or water vapor having an oxygen content of about 10% to 20% of the volume of the inlet gas. The inlet gas is moved through the retort at a rate of about 0.5 to 2 standard cubic feet of gas per minute per square foot of cross-sectional area of the retort.

The introduction of an inlet gas at the top and the withdrawal of flue gases from the retort at a lower level serves to carry the hot combustion product gases and non-oxidized inlet gases (such as nitrogen, for example) from the combustion zone and through the retort and establishes a retorting zone on the advancing side of the combustion zone. In the retorting zone, kerogen in the oil shale is converted to liquid and gaseous products. The liquid products move by the force of gravity to the lower boundary of the retort where they are collected and withdrawn, and the gaseous products mix with the gases moving through the in situ retort and are removed as retort off gas from a level below the retorting zone. The retort off gas is the gas removed from such lower level of the retort and includes inlet gas, flue gas generated in the combustion zone, and product gas generated in the retorting zone.

II. Formation of Retort by Multi-Directional Expansion

Figure 2:
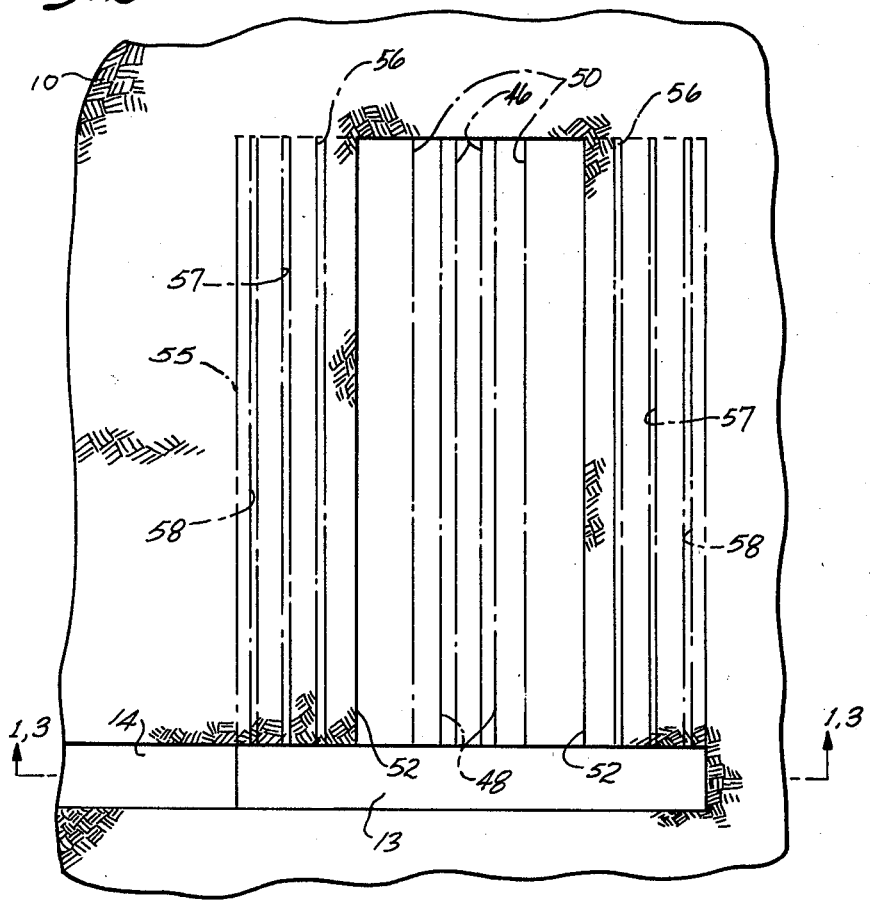
Figure 4:
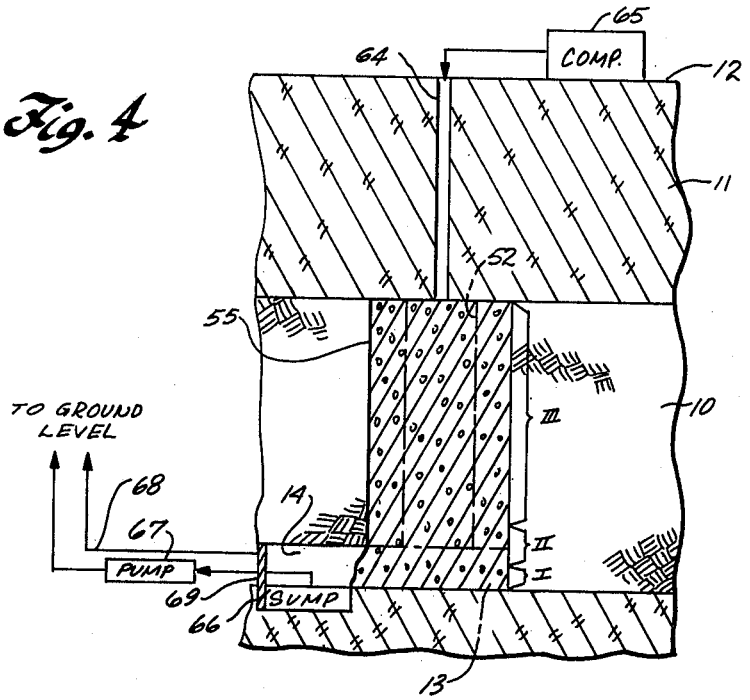
FIG. 4 is a side sectional view depicting a portion of the seam during retorting of the fragmented shale resulting from the expansion of the shale adjacent to the final columnar void in FIG. 2.

Reference is made to FIGS. 1, 2, and 4, which depict an approximately horizontal oil shale seam 10 in a subterranean oil shale deposit separated from ground level at 12 by an overburden 11. The term "seam" as used herein means the entire depth of a formation at least a part of which contains oil shale or the portion thereof under consideration. The formation containing oil shale in a vertically elongated retort 55 to be formed, represented in FIG. 2 by phantom lines, is to be fragmented for the purpose of recovering shale oil therefrom by an in situ retorting operation. Retort 55 can extend vertically from top to bottom of seam 10, can extend vertically through only part of the thickness of seam 10, or can extend vertically beyond the top and/or bottom of seam 10. In application Ser. No. 505,457, retort 55 is called a recovery zone. To prepare seam 10 for in situ recovery of shale oil, a horizontal room 13 is first excavated therein. Room 13, which in one embodiment has a square floor plan, extends along a level near the lower boundary of retort 55. A tunnel 14 and a shaft or drift, not shown, connect room 13 to ground level. The term "tunnel" is used herein to mean a horizontally extending subterranean passage, whether it be a tunnel, a drift, or an adit. Room 13 and tunnel 14 are formed by conventional mining techniques. The pillars, if any are necessary to support the roof of room 13, are formed from shale left in place during mining. The height of room 13, which is substantially smaller than any of the dimensions of its floor plan, is dictated by the spaced required to form the retort in the manner described below. A height of from about 12 feet to about 30 feet is found adequate in some embodiments. Tunnel 14 is preferably self-supporting, i.e., narrow enough that its roof does not subside in the absence of support pillars.

Next, a portion of the shale contained within the boundaries of the retort under formation 55 is excavated to form a columnar void from the ceiling of room 13 at the intersection of the diagonals of the floor plan to the upper boundary of retort 55. Although the columnar void is preferably cylindrical when multi-directional inward expansion of the shale is employed so that the shale can be expanded symmetrically about the free face of the columnar void, the columnar void can also be non-cylindrical in cross section, e.g., oval or square, etc.

The columnar void can be formed in any number of ways, one of which is to blast it out in its full cross section in a series of increments moving from the room toward the upper boundary of the retort.

Another method of forming the columnar void is to blast it out in its full length in a series of annular increments moving from the center outwardly.

Figure 3:
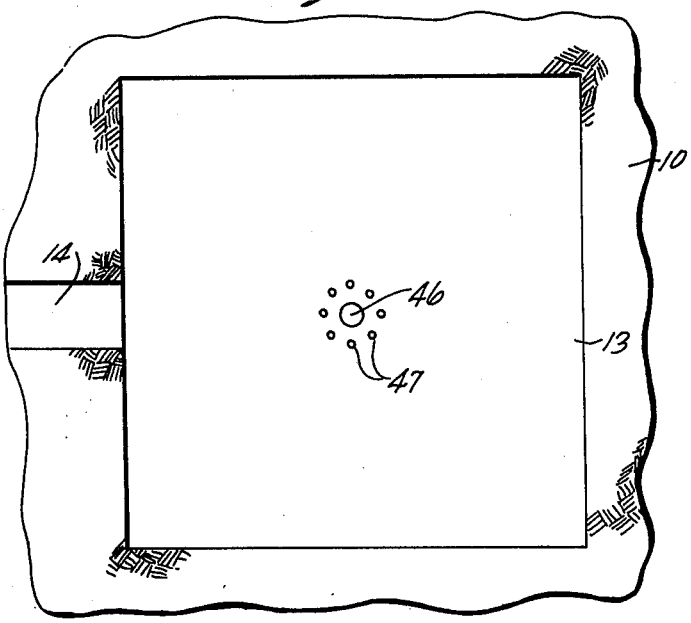

Reference is made to FIG. 3 for a description of one method of enlargement of the columnar void. The initial columnar void is designated 46. The cylindrical surface of initial columnar void 46 constitutes a free face from which the diameter of the columnar void may be enlarged in lateral annular increments.

A plurality of vertically extending blasting holes 47 are drilled upwardly from room 13 in a coaxial ring around and substantially parallel to columnar void 46. The enlargement of columnar void 46 involves the shale in the region between the free face established by the surface of columnar void 46 and the ring of blasting holes 47, which defines the boundary of the region to be fragmented between the ring of blasting holes and columnar void 46. Blasting holes 47 are spaced from the free face at columnar void 46 so that the shale in the region defined by the columnar void and the ring of blasting holes will expand toward the free face of the columnar void. The expanded shale should have sufficient void volume distributed therethrough that the expanded shale remains free to move down through the new columnar void created by detonating the explosive in blasting holes 47 into room 13.

Columnar void 52 has a vertical axis extending through the center of retort 55. The volume of retort 55 is defined approximately by the area of the floor plan of room 13 and the height of columnar void 52. In other words, the horizontal cross section of retort 55 coincides approximately with the floor plan of room 13 and the vertical length of retort 55 approximately equals the height of columnar void 52 and room 13. As shown, the horizontal cross section of columnar void 52 is preferably circular and the horizontal cross section of retort 55 is preferably square, so that the quantity of shale inwardly expanded in all directions normal to the free face in columnar void 52 is as nearly as possible the same, while minimizing the amount of intact shale left between adjacent retorts. However, the horizontal cross sectional of retort 55 could have a non-square rectangular shape, in which case the quantity of shale inwardly expanded in all directions about columnar void 52 would not be as nearly the same, or the horizontal cross section of retort 55 could have a circular shape, in which case more intact shale would be left between adjacent retorts.

All the shale extending away from the cylindrical free face between columnar void 52 and the side boundaries of retort 55 is explosively expanded toward the columnar void in a plurality of concentric annular layers of oil shale progressing outwardly away from the cylindrical free face in rapid sequence. The expansion is in a direction normal to the cylindrical free face of columnar void 52 and, within a ring of blast holes, is thus multidirectional. In other words, each layer completely surrounds the free face of columnar void 52. Each layer is completely severed from the adjoining shale to form a new cylindrical free face on the unfragmented oil shale prior to the severance of the next layer; but the sequence is sufficiently rapid so that all the layers move toward the longitudinal axis of columnar void 52, i.e., in a horizontal direction, to fill the space before the shale if any layer drops appreciably due to gravity.

The void fraction of the resulting fragmented shale depends upon the ratio of the horizontal cross-sectional area of columnar void 52 to the horizontal cross-sectional area of retort 55, which is approximately the same as the area of the floor plan of room 13. If different local void fractions are desired at different levels of retort 55, the horizontal cross-sectional area of columnar void 52 and/or retort 55 would vary accordingly. As discussed below, it is also noted that at the bottom of retort 55, the local void fraction of the fragmented shale is increased by room 13, but the increase does not extend more than about twice the height of room 13. Thus, to control the void fraction in the retort remote from room 13, one selects the diameter for columnar void 52.

In this embodiment, the horizontal cross section of retort 55 is about 35 feet by about 35 feet, the diameter of columnar void 52 is about 16 feet, and the vertical height of retort 55 is about 80 feet.

To prepare the region around columnar void 52 for explosive expansion, concentric rings 56, 57, and 58 of vertical blasting holes are drilled upwardly from room 13 along the entire length of columnar void 52. Rings 56, 57, and 58 are coaxial with columnar void 52. A closed square border 59 of vertical blasting holes covers the corners of the region to be fragmented. Border 59 defines the horizontal cross-sectional area of retort 55. In practice, it is not possible to drill border holes 59 precisely along the edges of room 13, so the horizontal cross-sectional dimensions of retort 55, i.e., 35 feet by 35 feet, will be slightly smaller than the dimensions of room 13, i.e., 38 feet by 38 feet. Blasting holes 56 through 59 are thus parallel to the free face of columnar void 52. About one-quarter of the blasting holes are represented in FIG. 1.

The entire length of the blasting holes is loaded from room 13 with an explosive, such as dynamite or ANFO. In the case of ANFO, about 0.5 to 1.5 net tons of shale can be fragmented per pound of explosive. The explosive in the blasting holes is detonated in a single round, i.e., in an uninterrupted sequence, in the following order in FIG. 1:

(a) ring or group of blasting holes 56
(b) ring or group of blasting holes 57
(c) ring or group of blasting holes 58
(d) border group of holes 59, with the exception of the corner holes
(e) the corner holes of border group of holes 59

On the one hand, the time delay between each of the above steps is sufficiently large to permit the layer of shale created by detonating the explosive in each ring to be fragmented and to completely break away from the remaining shale surrounding it, thereby creating a new free face prior to the detonation of the explosive in the next ring of blasting holes. This insures that the shale does not fracture without fragmenting. On the other hand, the time delay between each of the above steps is short enough so that the layers of fragmented shale do not fall appreciably due to gravity before the blasting sequence is completed. This promotes a more uniform distribution of the void volume and permeability along the height of retort 55. In summary, the delay between the steps of the sequence is such that the shale surrounding columnar void 52 expands inwardly in discrete fragmented layers of oil shale to fill the available space before expanding appreciably in a downward direction.

Prior to detonation of the charge in rings 56, 57, and 58, and border 59, a portion of the rubble removed in the course of the formation of room 13 is returned to room 13 to increase the quantity of shale in the retort. In the embodiment given above, where the height of room 13 is about 12 feet, the returned rubble can be placed in room 13 to a level of about 6 feet, leaving room 13 with a space about 6 feet high prior to explosive expansion of the oil shale surrounding the columnar void. The room can also be completely filled or left empty.

Reference is made to FIG. 4, which depicts seam 10 after fragmentation of the shale contained in retort 55, which has top, bottom, and side boundaries of unfragmented shale. The void fraction will generally vary from top to bottom of retort 55, i.e., between horizontal segments of the retort. A region I at the bottom of retort 55, which corresponds to the rubble returned to room 13 prior to explosive expansion, has a void fraction (volume of void/total volume of region) of approximately 0.4 or 40%. In a narrow region II (not drawn to scale) which extends above region I to a height several times the height of the space in the room above the rubble that has been returned to room 13, the shale adjacent to columnar void 52 expands downwardly as well as inwardly and has a void fraction of approximately 30%. In a region III, which extends between region II and the top of retort 55, i.e., the major portion of the height of retort 55, the shale adjacent to columnar void 52 expands inwardly and has a void fraction governed by the ratio of the horizontal cross-sectional area of columnar void 52 to that of retort 55, i.e., in this embodiment approximately 0.18 or 18%. This ratio is sufficiently small so the expanded shale adjacent to columnar void 52 fills columnar void 52 and the space occupied by the expanded shale and is sufficiently large so the expanded shale is capable of completely fragmenting. The overall void fraction within retort 55 in this embodiment is approximately 20%. Regions I, II, and III together comprise one continuous mass of fragmented oil shale. The former locations of room 13 and columnar void 52 are shown by phantom lines.

Room 13 is used to prepare the shale surrounding columnar void 52 for inward expansion in successive layers of oil shale, in other words, to provide the access needed to drill blasting holes around columnar void 52, and to load such blasting holes with explosive charge. The higher void volume in regions I and II results inherently from room 13, and reduces somewhat the total quantity of shale oil obtained from these regions because less shale is present for retorting.

A gas inlet to the top of the retort represented for simplicity as a single conduit 64, connects a compressor 65 located at ground level 12 to one or more points distributed about the top of retort 55. Because of the permeability of the fragmented shale, compressor 65 is usually required to deliver air or other retorting gas at about 5 psi or less.

The fragmented shale at the top of the retort is ignited to establish a combustion zone, compressor 65 supplies air or other oxygen supplying gas for maintaining combustion in the combustion zone and for advancing the combustion zone slowly downward through the retort with a horizontal advancing front. Carbonaceous values comprising liquid shale oil and gases are released from the fragmented shale by the heat from the combustion zone in a retorting zone which is ahead of the advancing front of the combustion zone. Heat from the combustion zone is carried to the retorting zone on the advancing side of the combustion zone by combustion product gases and heated unburned inlet gases, such as nitrogen of the inlet air, which are caused to flow downwardly by the continued introduction of gases through the inlet to the top of the retort, and the withdrawal of gases from the bottom of the retort. The flowing hot gases heat the oil shale in the retorting zone a few feet thick. Kerogen in the oil shale is decomposed in the retorting zone releasing shale oil and some hydrocarbon gases. The unfragmented shale bordering the retort 55 is also partially retorted. The shale oil percolates downward to the bottom of the retort 55 in advance of the combustion zone, and the retort off gas is passed to the bottom of the retort 55 by the movement of gas introduced at the top of the retort 55, passed through the retort 55, and withdrawn at the bottom. Shale oil collects in a storage area in the form of a sump 66 which is located at the low point of an access to the bottom of the retort. Depending upon the slope of room 13, special grading and/or drainage ditches can be provided in the retort floor prior to the explosive expansion in order to provide drainage for the shale oil to sump 66. A pump 67 carries the shale oil from sump 66 to ground level. A conduit 68 carries the off gas recovered from the retorting process from a sealed bulkhead 69 in tunnel 14 to ground level.

Alternatively, an oxygen free retorting gas at a temperature sufficient to heat the fragmented oil shale in the retort to a retorting temperature is introduced into the top of the retort, bringing about the retorting of the oil shale in a retorting zone, and withdrawing the shale oil and gaseous retorting products from the in situ retort.

Figure 6:
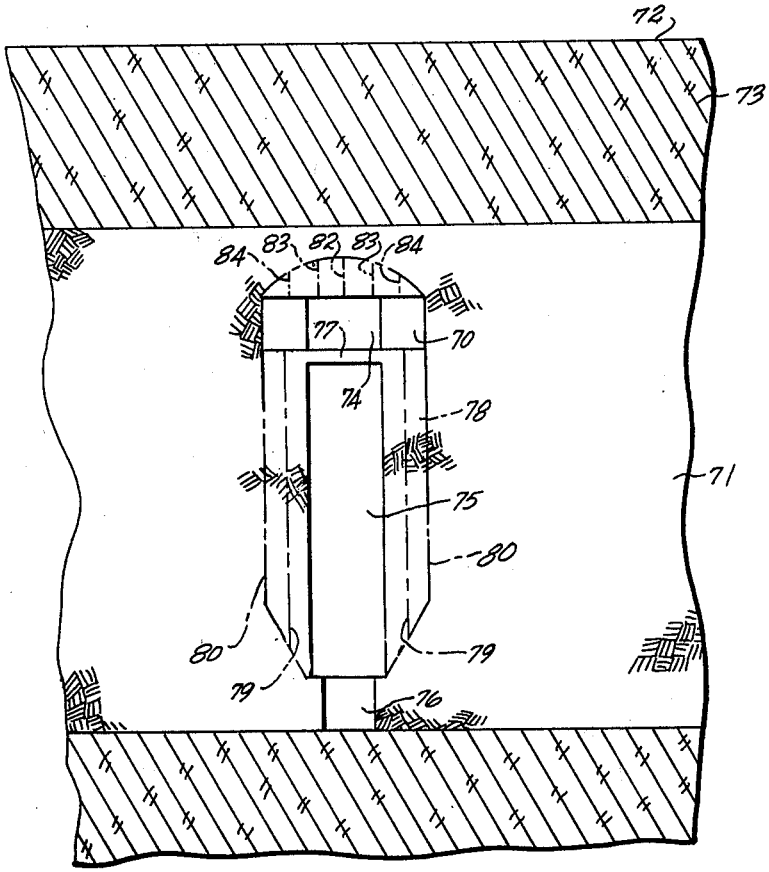
FIGS. 5 and 6, which are side sectional views through orthogonal vertical planes, depict another portion of an oil shale seam in which a room employed to prepare a retort for fragmentation is located above a columnar void.
Figure 5:
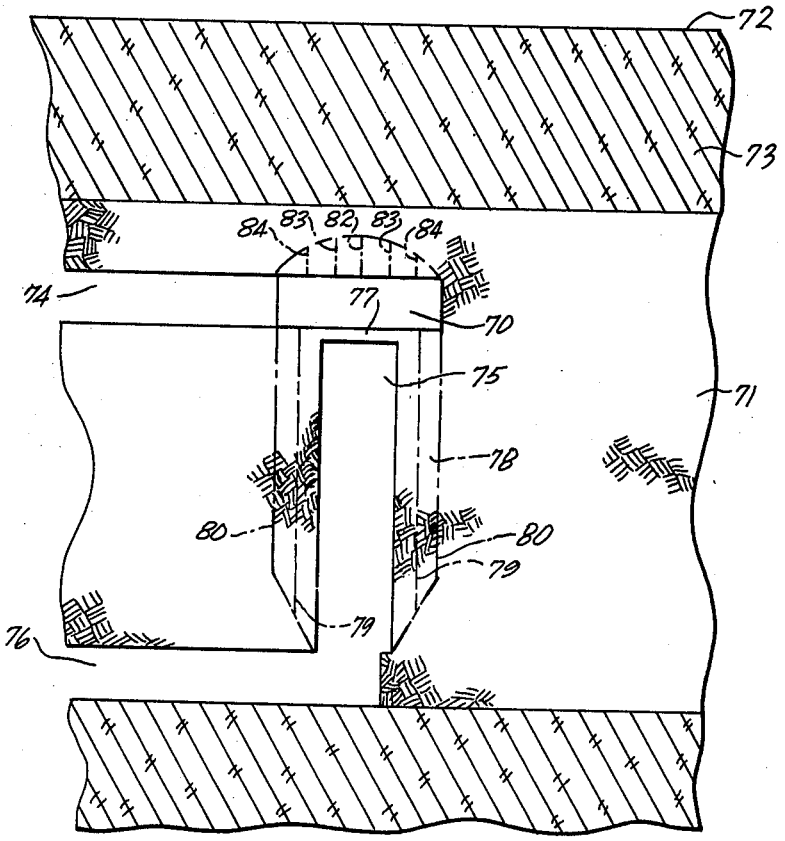

Reference is made to FIGS. 5 and 6 for another embodiment of the invention in which the columnar void extends below the room. A horizontal room 70 is excavated near the top of a retort to be formed in a subterranean oil shale seam 71, which is separated from ground level at 72 by an overburden 73. A tunnel 74 and a shaft or drift (not shown) connect room 70 to ground level. A cylindrical columnar void 75 is excavated from just below the center of the floor of room 70 to a tunnel 76, which is located below the retort. Tunnel 76 is also connected to ground level by a shaft or drift (not shown). Columnar void 75 is formed in the manner described above in connection with FIGS. 1 through 3. The top of columnar void 75 terminates short of room 70. The shale left between columnar void 75 and room 70 forms a horizontal pillar 77, which leaves the floor of room 70 free from a hazardous condition, namely, a large opening, during the operations subsequently conducted therefrom. The debris created during formation of columnar void 75 falls into tunnel 76 and is transported therefrom to ground level. Most advantageously, tunnel 76 is utilized for two functions—first, during the formation of columnar void 75, as a base of operation from which the work takes place and an egress for removal of debris, and second, during retorting, as a point of collection for hydrocarbon values and an egress for removal thereof. The sump for collecting shale oil is located in tunnel 76 after the in situ retort is formed. In this embodiment, tunnel 76 is formed before columnar void 75. Alternatively, the first function can be performed from room 70, in which case pillar 77 is eliminated and tunnel 76 can be formed after columnar void 75 is formed.

The shale in a retort 78, represented in FIGS. 5 and 6 by phantom lines, is to be fragmented. Concentric rings 79 and 80 of vertical blasting holes are drilled downwardly from room 70 along the length of columnar void 75. A closed square border of vertical blasting holes (not shown in FIGS. 5 and 6) extends around the edge of retort 78. Except for two rings instead of three, the blasting holes are distributed in the manner described and shown above in connection with FIGS. 1 and 2. In one embodiment, columnar void 75 has a diameter of 60 feet, ring 79 has a diameter of 90 feet, and ring 80 has a diameter of 120 feet, the blasting holes of each of rings 79 and 80 are spaced about 15 feet apart and have a diameter of about 6¼ inches. The blasting holes of the square border are spaced about 18 feet apart and have a diameter of about 7½ inches. In the corners, additional 7½ inch blasting holes are provided between ring 80 and the square border along arc segments 15 feet from ring 80. The bottom of retort 78 is funnel-shaped so as to improve the distribution of gases flowing into tunnel 76. Thus, the blasting holes of rings 79 are shorter in length than columnar void 75; blasting holes 80 are shorter than holes 79, and holes 81 are shorter than holes 80, so as to provide the desired slope for the bottom of retort 78, but they do extend a principal portion of the entire height of columnar void 75.

In situ retort 78 has a funnel-shaped bottom with a higher void volume than the remainder of the retort 78. In other words, the bottom of the retort has an inverted, right conical surface with a base that meets the vertical sides of the retort and a point of convergence at tunnel 76. The funnel-shaped bottom can be formed in one of two ways.

The first way is to drill vertical blasting holes that have different lengths and to form the fragmental shale in the bottom of the retort 78, at the same time the remainder of the retort is fragmented. Thus, the blasting holes of rings 79 and 80, and border 81, respectively, are incrementally shorter in length than columnar void 75 so as to provide the desired slope on the bottom of the retort. The ratio of the cross-sectional area of the columnar void to the horizontal cross-sectional area of the retort and, thus, the void volume of the fragmented shale, increases at the bottom of the retort because the horizontal cross-sectional area of the retort decreases.

The second way is to mine out a funnel-shaped cavity and then backfill the cavity with fragmented shale prior to explosively expanding the shale in the retort 78 above the funnel-shaped backfilled region. This could be done by forming an access tunnel where the conical surface of the bottom meets the vertical side surfaces. Backfilled shale naturally has a void volume of about 40%.

Retort 78 is provided with a dome-shaped top. To form the dome-shaped top, a central blasting hole 82 and concentric rings of blasting holes 83 and 84 are drilled upwardly from room 70. The length of these blasting holes vary in accordance with the desired dome shape. The blasting holes in the first or inner ring surrounding central blasting hole 82 are shorter than blasting holes 82. The blasting holes in each concentric ring progressing outwardly are shorter than the blasting holes in the next preceding inner ring. The volume of shale included within the dome-shaped top of retort 78 above room 70 is sufficiently large that after explosive expansion of the shale, fragmented shale completely fills the volume within room 70 and the dome, thereby providing support for overburden 73. In one embodiment, the distance from the ceiling of room 70 to the top or vertex of the dome is less than about 95% of the smallest linear dimension of room 70, e.g., the side dimension in a room with a square floor plan. Distances greater than about 95% of the smallest linear dimension of room 70 may require a sequential series of blasting steps. To reduce the volume of shale expanded above room 70, a portion of the rubble removed in the course of the formation of room 70 can be returned thereto prior to explosive expansion.

After fragmentation of the shale within the retort 78, it has a polygonal, specifically square, horizontal cross section, which permits most efficient fragmentation of most shale deposits. The permeability and void volume of the fragmented shale within the retort have substantial horizontal uniformity. Although the void volume varies from top to bottom of the retort, i.e., between horizontal planes, this does not impair the effectiveness of the retorting process. The region between room 70 and the funnel-shaped bottom of the retort has a void volume of approximately 18%, i.e., a void volume determined by the ratio of the cross-sectional area of the columnar void 75 to the horizontal cross-sectional area of the retort 78. The funnel-shaped region at the bottom of the retort and the dome-shaped region including room 70 at the top of the retort have a void volume larger than 18%. Preferably, the void volume in the funnel-shaped region at the bottom of the retort is between about 30% and 40%.

The blasting holes are loaded from room 70 with an explosive, such as ANFO, pillar 77 is explosively fragmented, the explosive in the blasting holes surrounding the columnar void is detonated in an outwardly moving sequence, as described above in connection with FIGS. 1 and 2, and the explosive in the blasting holes extending above the room is detonated, to produce a fragmented permeable mass of shale within retort 78. The shale within retort 78 is then retorted in the manner described above in connection with FIG. 4.

What is claimed is:

1. A method of preparing a subterranean mineral deposit for in-situ extraction of mineral values therefrom comprising the steps of:

selecting a portion of said deposit for processing;

providing an outlet in communication with an area defining a base of said selected portion of said deposit;

providing an inlet communicating with said selected portion at a point spaced from said outlet so that said portion lies substantially between said inlet and said outlet;

breaking said portion of said deposit into rubble defining a permeable zone extending between said inlet and said outlet and increasing in permeability from said inlet to said outlet so that the process of extraction may be initiated at the inlet and the extracted minerals transported through high permeability area to the outlet.

2. A method of preparing a subterranean mineral deposit for in-situ extraction of mineral values therefrom comprising the steps of:

selecting a portion of said deposit for processing;

providing an outlet in communication with an area defining a base of said selected portion of said deposit;

providing an inlet communicating with said selected portion at a point spaced from said outlet so that said portion lies substantially between said inlet and said outlet;

breaking said portion of said deposit into rubble defining a zone of permeability extending between a point at least halfway to said inlet from said outlet and increasing in permeability from said point to said outlet so that the process of extraction may be initiated at the inlet and the extracted minerals transported through high permeability area to the outlet.

3. An in situ oil shale retort in a subterranean deposit containing oil shale containing a fragmented permeable mass of particles containing oil shale, the in situ retort having a top, a bottom, and vertical sides extending between the top and bottom, the fragmented mass adjacent to the bottom of the retort having a larger void volume than the remainder of the fragmented mass in the retort;

a source of gas capable of releasing shale oil from oil shale upon exposure to oil shale in the fragmented mass in the in situ retort;

means for coupling the source of gas to the top of the in situ retort to release shale oil from the fragmented mass in the in situ retort; and means for removing released shale oil from the bottom of the in situ report.

4. The retort of claim 3 in which the void volume of the portion of the fragmented mass adjacent the bottom is between 30% and 40% and the void volume of the remainder of the fragmented mass is less than 20%

* * * * *